United States Patent [19]

Tsilibes

[11] Patent Number: 4,507,373

[45] Date of Patent: Mar. 26, 1985

[54] METHOD AND APPARATUS FOR UNIFORMLY CHARGING A SURFACE

[75] Inventor: George N. Tsilibes, Rochester, N.Y.

[73] Assignee: Eastman Kodak Company, Rochester, N.Y.

[21] Appl. No.: 538,602

[22] Filed: Oct. 3, 1983

[51] Int. Cl.[3] ..... G03G 13/02; G03G 13/22; G03G 15/02

[52] U.S. Cl. ..... 430/31; 430/902; 250/325; 355/3 CH; 361/229

[58] Field of Search ..... 430/31, 902; 250/325; 355/3 CH; 361/225, 229

[56] References Cited

U.S. PATENT DOCUMENTS

| | | | |
|---|---|---|---|
| 2,778,946 | 1/1957 | Mayo . | |
| 3,233,156 | 2/1966 | Jarvis et al. . | |
| 3,307,034 | 2/1967 | Bean . | |
| 3,456,109 | 7/1969 | Gawron . | |
| 3,470,417 | 9/1969 | Gibbons . | |
| 3,476,935 | 11/1969 | Metcalfe et al. . | |
| 3,603,851 | 9/1971 | Metcalfe . | |
| 3,649,830 | 3/1972 | Sato et al. . | |
| 3,655,966 | 4/1972 | Takimoto et al. . | |
| 3,678,350 | 7/1972 | Matsumoto et al. | 361/229 |
| 3,729,649 | 4/1973 | La Chappelle et al. . | |
| 3,779,749 | 12/1973 | Sato | 430/902 X |
| 3,788,844 | 1/1974 | Sato et al. | 430/902 X |
| 4,353,970 | 10/1982 | Dryczynski et al. | 430/902 X |

*Primary Examiner*—Roland E. Martin

*Attorney, Agent, or Firm*—Norman Rushefsky

[57] ABSTRACT

In an electrophotographic reproduction apparatus and method, a moving photoconductor is charged by a primary corona charger that includes a corona wire. Nonuniformities in the charge pattern produced on the photoconductor by this primary line charger are reduced by subjecting the photoconductor to a second corona charger having point charging electrodes.

15 Claims, 3 Drawing Figures

FIG. 2
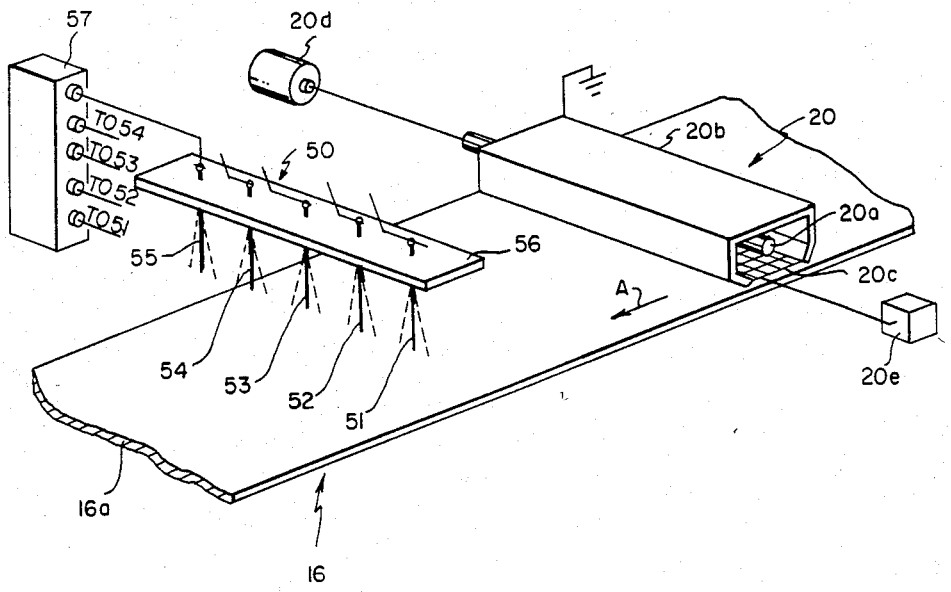
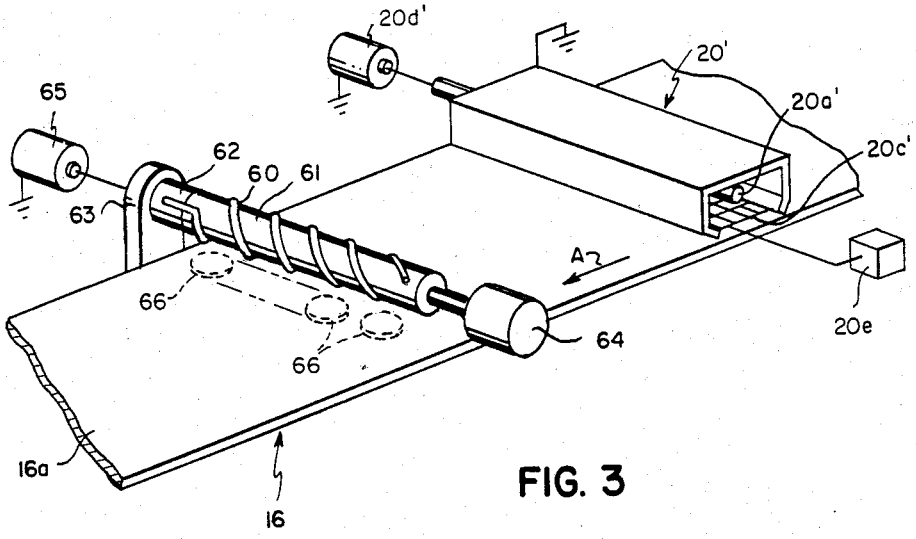
FIG. 3

METHOD AND APPARATUS FOR UNIFORMLY CHARGING A SURFACE

CROSS REFERENCE TO RELATED APPLICATION

This application is related to U.S. application Ser. No. 538,294, filed in the name of the same inventor hereof on even date herewith and entitled Method and Apparatus For Controlling Charge On A Photoconductor.

BACKGROUND OF THE INVENTION

1. Field of the Invention

This invention relates to electrophotography, and more particularly to an improved method and apparatus for controlling the level of electrostatic charge on a surface upon which an electrophotographic image is to be made.

2. Description of the Prior Art

In known electrophotographic reproduction apparatus such as copiers or duplicators, an electrostatic charge is deposited on an area of a recording element, e.g., a photoconductor as the area is moved past a charging station. The photoconductor is then moved to an exposure station where the area is exposed to image-forming radiation to form a latent electrostatic image of a document to be copied. The latent image is thereafter developed and, in the case of plain-paper copiers and duplicators, subsequently transferred to paper upon which the copied image is to appear. Thereafter, the photoconductor is cleaned and otherwise made ready for the next copy cycle.

In such apparatus, it is important to impart a generally uniform charge over the area upon which the latent image is to be formed. Too low a charge in portions of the area may result in weak, washed-out looking areas on copies, and too great a charge in portions of the area may result in areas on copies being too dark relative to other areas. Therefore, copy quality, particularly with pictorial subject matter, is affected seriously where a non-uniform charge is placed on the photoconductor.

In the prior art, the known electrostatic charging devices with corona discharge can be classified into two categories, one using corona wire or line electrodes and the other using needle or point electrodes. The device using a corona wire electrode comprises a wire strung transverse to the direction of movement of the photoconductor. Generally speaking, this device is easier to manufacture but is known to have uneven discharge along the wire resulting in nonuniform electrostatic charging, particularly in the case of negative corona discharge. Discrete glow spots often occur along a negatively charged corona wire. The glow spots are associated with creating non-uniformities in charging of the photoconductor. As the glow spots appear at different positions along the wire over the course of a day due to changes in humidity within the copier or because of other factors, the non-uniformity of charging will thus change with time (see R. M. Schaffert, *Electrophotography,* 1975 edition, pages 466–472). While minor amounts of non-uniformity may be tolerated, significant non-uniformity as indicated above presents a problem. The extent of the problem will depend upon the nature of the apparatus and the material to be copied. Obviously, continuous tone or halftone originals will be more of a problem than copying text. Color copiers demand even more uniformity in charging than do monotone copiers.

Devices using needle or point electrodes arranged in a row across the photoconductor are known to provide an electrostatic potential distribution which is not uniform but which show a repeated pattern corresponding to the arrangement of the electrodes. The pattern appears in streaks along the direction of movement of the surface to be charged with respect to the arrangement of the needle electrodes. As noted in U.S. Pat. No. 3,649,830, various attempts have been undertaken to increase the uniformity of charging using needle electrodes such as by reducing the angle between the row of needles and the direction of movement of the photoconductor or causing the electrodes to be reciprocated; i.e., moved back and forth across the photoconductor, to minimize the pattern effect. The former attempt requires a larger space for a charging device than in the example where the needles are arranged in a row perpendicular to the direction of movement of the photoconductor whereas the latter attempt requires a relatively complex apparatus for reciprocating the needles.

It would therefore be very desirable to have an improved method and apparatus for providing over the image-forming area of a photoconductor a generally uniform charge.

SUMMARY OF THE INVENTION

The invention pertains to an improved charging apparatus and method for applying a uniform charge to a moving surface wherein a corona current generating line-charger first charges the surface and thereafter corona current generating point-chargers modify the charge on the surface so that the final charge is more uniform than that provided by just the line-charger.

BRIEF DESCRIPTION OF THE DRAWINGS

FIG. 2 is a schematic perspective view of a first embodiment of a corona charging apparatus of the invention;

FIG. 3 is a schematic perspective view of a second embodiment of a corona charging apparatus of the invention;

DESCRIPTION OF THE PREFERRED EMBODIMENT

Figure 1:
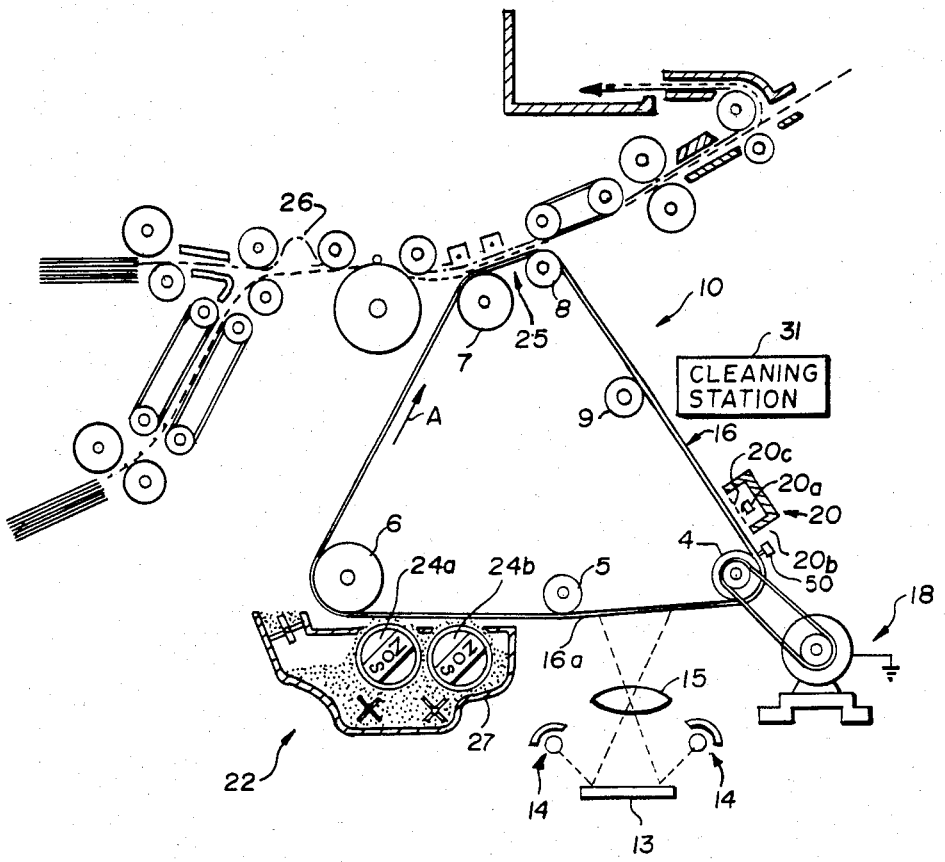
FIG. 1 is a schematic elevation view of a copier/duplicator which embodies apparatus in accordance with the invention.

Because apparatus of the type described herein are well known, the present description will be directed in particular to elements forming part of or cooperating more directly with the present invention.

For a general understanding of a web-type electrophotographic copier/duplicator apparatus 10 wherein the invention has utility, reference is made to FIG. 1. As shown, a photoconductor member, in the form of a photoconductive web 16, is trained about rollers 4 through 9 for movement in the direction indicated by the arrow A. Roller 4 is driven by a drive mechanism 18 shown for simplicity to include a motor-pulley arrangement. An insulating layer or surface **16*a* of the web 16 is charged at a primary corona charge station (charger) 20. The charger 20 includes one or more corona generating wires 20*a*, a shield 20*b*, and a grid electrode 20*c* for regulating the flow of negative corona current from the wires to the photoconductor member. Secondary charger 50 is also employed downstream of the primary charger for providing a more uniform charge than provided by the primary charger alone. Thereafter and at an appropriate time, an information medium 13 such as a document is illuminated at an image exposure station by radiation from flash lamps 14. Such radiation is reflected from the medium and projected by a lens 15 onto the charged insulating surface 16***a* of the web 16, to selectively dissipate charge and form an electrostatic latent image of medium 13 on a specific area of the web. For more specific disclosures of the web, see commonly assigned U.S. Pat. Nos. 3,615,406 and 3,615,414, both issued Oct. 26, 1971.

The apparatus 10 further includes a development station 22 at which the moving electrostatic image is contacted with finely divided charged toner particles that adhere to the charged web surface in a configuration defined by the electrostatic image, to form a visible toner image; a transfer station 25 in which the toner image is transferred to a receiving surface of a copy sheet 26 on which it can be subsequently permanently fused; and a cleaning station 31 in which residual toner particles are removed from the web 16.

At the development station an electrostatic image on the insulating surface 16*a* of web 16 is moved past two magnetic brushes or rollers 24*a* and 24*b* mounted in a housing 27 of the development station 22. The housing 27 holds a supply of developer containing a mixture of toner and carrier particles. The brushes 24*a* and 24*b* can be constructed according to any one of a variety of designs known in the prior art. One such design is shown in commonly assigned U.S. Pat. No. 3,543,720 issued Dec. 1, 1970, in the names of Drexler et al. For a specific example of such a developer, see commonly assigned U.S. Pat. No. 3,893,935, issued July 8, 1975 to Jadwin et al. For a more complete description of the general organization of a similar copier apparatus, reference may be made to commonly assigned U.S. Pat. No. 4,025,186, issued May 24, 1977 to Hunt et al.

Although a web-type copier/duplicator has been shown, it will be understood that the present invention is also particularly suitable with copier/duplicator apparatus that use drums and also sheet film photoconductors. In any case, it will be understood by those skilled in the art that a microcomputer having a stored program can be effectively used as the logic and control apparatus to control the operation of the copier/duplicator. The details of one such microcomputer is disclosed in the above-referenced U.S. Pat. No. 4,025,186.

Turning now to FIG. 2, there is shown a schematic representation of apparatus that is assembled in accordance with the invention.

As noted above, to prepare the photoconductor 16 for exposure, a uniform charge of say −550 volts is needed to be formed on the photoconductor. A conventional primary charger 20 has its corona current generating wire 20*a* charged by conventional high negative voltage source 20*d* to a voltage level sufficient to form a corona current between the wire and the photoconductor. Voltage levels of −4000 to −6000 volts are normally sufficient for this purpose. The level to which the photoconductor is charged is controlled by grid electrode 20*c* which is located between the wire and the photoconductor and biased by suitable conventional grid voltage biasing means 20*e* at the desired voltage level of the photoconductor known generally as $V_o$ and in this specific example −550 volts. A metal shield 20*b* is located about the wire 20*a* and is suitably biased or grounded. The shield is insulated from the grid and spaced from the wire. The type of charger just described is conventional and known as a "line-charger" which term as used herein comprises a source of charge which emanates along a line and whose points are generally equally displaced from the surface to be charged. This line or wire is supported a small distance from the photoconductor and lies transverse to the direction of movement of the photoconductor past the line. After being charged by the line-charger 20, the voltage level of the segment so charged will be generally about −550 volts assuming that usual factors such as photoconductor speed, wire-photoconductor separation distance, screen biasing etc, have been preset to provide the desired voltage goal. However, because of non-uniformities in output by the wire, variations in charge level from point-to-point along the transverse width of the photoconductor are commonly observed. To reduce this transverse variation in charge, a second corona charger 50 is provided which produces charge from what are known as point source chargers. These point chargers may each be biased by a voltage source 57 to a suitable predetermined voltage, between −4000 to −7000 volts, that is sufficient for generating a corona current discharge onto the photoconductor. The point chargers comprise flexible wires 51–55 which are supported as cantilevers from a support 56 and arranged in a row across the transverse width of the photoconductor. The wires are directed perpendicularly toward the photoconductor surface to be charged so that an end point of each charger comprises the closest part of the wire to the photoconductor surface. The wire, since it is charged, is responsive to charge on the photoconductor as the photoconductor passes beneath the wire and causes the wire to flex due to electrostatic repulsion forces arising from relatively higher charged areas on the photoconductor. As the wires each vibrate or wiggle due to instantaneous electrostatic field conditions, corona current is "sprayed" by them onto the photoconductor over an area immediately below each of them. The charge will end to distribute at points in such areas where charge level is relatively low and thus these "valleys" of charge potential tend to be built up to the higher levels and result in a more uniform charge distribution. While five flexible point charging wires are shown, the number chosen may be fewer or greater. Even one might be used wherein it is supported on a carriage and transported across the width of the photoconductor.

To minimize repulsion effects between two charged adjacent electrodes, the voltage source may have a pulsed output to each wire and these pulses timed so that only one wire is charged at a time or alternate wires may be coupled together so that wires 55, 53, and 51 are charged simultaneously and wires 54 and 52 charged during a different period or the pulses to each wire may be made random.

With reference now to FIG. 3, a second embodiment is shown. Reference to this embodiment should also be considered in conjunction with U.S. Pat. No. 3,233,156 (Jarvis) the contents of which are incorporated herein by this reference. In this embodiment a primary line corona charging station is shown that is similar to that described above in FIG. 2. Similar elements thereof are thus identified with a (') and the operation of the primary charging station in this embodiment is similar to that previously described with regard to the embodiment of FIG. 2. In this embodiment the point chargers comprise a corona wire 60 which is wound as a helix about a supporting cylindrical insulator rod 61. The axis of the helix lies transverse to the direction of movement of the photoconductor. A metal collar 62 on the insulator rod 61 is supported in a metal bearing 63 and the rod and helix are rotated at high speed relative to the photoconductor by motor 64. A source of high voltage 65 is coupled to the bearing 63 and biases the wire to a predetermined voltage between −4000 to −7000 volts and which is sufficient to produce a corona discharge current from the points on the wire. Points on the wire closest to the photoconductor tend to spray corona onto the photoconductor selectively. Areas 66 on the photoconductor and immediately adjacent respective emitting points on the helix receive this spray of charge but the charge will tend to distribute within each of these areas preferentially so as to fill the heretofore described charge valleys in the respective areas. As the helix is rotated, different points thereon commence to spray charge onto the respective areas 66 beneath them and the helix thereby comprises an equivalent of many point chargers emitting charge at different times. Other configurations of helical "point" chargers are illustrated in referenced U.S. Pat. No. 3,233,156 and may be used herein as a secondary corona current charger. More than one helical wire may be wrapped about the insulator bar 61 and these wires will be insulated from each other so that they may be separately charged to increase the effective number of point chargers. Voltage pulses may be applied to these different helices and timed so that corona is emitted from the wires at different times.

Modifications may include the use of a grid electrode beneath the point charger and biased by a suitable voltage source to $V_o$ to further control the level of charge to which the photoconductor is raised.

The invention has been described in detail with particular reference to preferred embodiments thereof, but it will be understood that variations and modifications can be effected within the spirit and scope of the invention.

I claim:

1. A method for forming an electrostatic latent image comprising (a) moving in a first direction a member having a surface upon which an electrostatic latent image may be formed by image-bearing radiation;

(b) generating a corona current along the length of a line-charging element while the surface moves past the line-charging element to produce an electrostatic charge on the surface;

(c) generating a corona current from one or more point-charging elements as the charged surface moves past the point-charging elements to provide a more uniform charge over the surface than provided in step (b) above, (d) exposing the charged surface to image-bearing radiation after it has been uniformly charged by the line and point-charging means to form the latent electrostatic image.

2. The method of claim 1 and including the step of developing the latent electrostatic image into a visible image.

3. A method of uniformly charging a moving surface comprising the steps of (a) applying an electrostatic charge on the moving surface by directing the surface through a first corona which extends as a line across the surface transverse to the direction of surface movement, and (b) applying additional charge on the moving surface in areas of lower charge by directing the surface through a plurality of independently established coronas which in combination extend across the surface transverse to the direction of surface movement.

4. Charging apparatus for applying a uniform electrostatic charge to a moving surface, the apparatus comprising:

first charging means including a line-charger having a wire for producing a corona current from the wire to the surface along a length of the wire which extends in a direction transverse to the direction of movement of the surface past the line-charger; and second charging means including point-charging elements located downstream of the line-charger for generating corona current from one or more points on the elements to the moving surface and cooperating with the line-charger to provide a more uniform charge over the moving surface than provided by the line-charger.

5. The charging apparatus of claim 1 wherein the point-charging elements comprise a plurality of flexible needle electrodes which are sufficiently resilient to flex in response to electrostatic forces resulting from the charge potential distribution on the surface and the potential on the needle.

6. The charging apparatus of claim 5 and including means for impressing corona producing pulsed electrical potentials to said needle electrodes with adjacent electrodes receiving their respective corona producing potentials at different times.

7. The charging apparatus of claim 4 wherein the point-charging elements comprise a rotating helical charging means for providing charge at different points in time which points collectively in time provide a corona current across a transverse width of the surface as the surface moves in a direction parallel to the length of the surface.

8. A method for applying a uniform electrostatic charge to a moving surface, the method comprising the steps of:

(a) generating a corona current along the length of a line-charging element while the surface moves past the line-charging element to produce an electrostatic charge on the surface; and (b) generating a corona current from one or more point-charging elements as the charged surface moves past the point-charging elements to provide a more uniform charge over the surface than provided in step (a) above.

9. An electrophotographic reproduction apparatus comprising:

a member having a surface upon which an electrostatic latent image may be formed by imaging radiation;

means for moving the surface in a first direction;

first charging means including a line-charger having a wire for producing a corona current from the wire to the surface along a length of the wire which extends in a direction transverse to the direction of movement of the surface past the line-charger to provide an electrostatic charge on the surface;

second charging means including point-charging elements located downstream of the line-charger for generating corona current from one or more points on the elements to the moving surface and cooperating with the line-charger to provide a more uniform charge over the moving surface than provided by the line-charger; and exposure means for exposing the charged surface to image-bearing radiation after it has been uniformly charged by the line charger and point-charging elements to form the electrostatic latent image.

10. The apparatus of claim 9 and including developing means for developing the latent electrostatic image into a visible image.

11. The apparatus of claim 10 wherein the point-charging elements comprise a plurality of flexible needle electrodes which are sufficiently resilient to flex in response to electrostatic forces resulting from the charge potential distribution on the surface and the potentials on the needle electrodes.

12. The apparatus of claim 11 wherein the surface is a photoconductor.

13. The apparatus of claim 12 and including the means for impressing corona producing pulsed electrical potentials to said needle electrodes with adjacent electrodes their respective corona producing potentials at different times.

14. The apparatus of claim 10 wherein the point-charging elements comprise a rotating helical charging means for providing charge at different points in time which points collectively in time provide a corona current across a transverse width of the surface as the surface moves in a direction parallel to the length of the surface.

15. The apparatus of claim 14 wherein the surface is a photoconductor.

* * * * *